US011134337B2

(12) United States Patent
Silver

(10) Patent No.: US 11,134,337 B2
(45) Date of Patent: Sep. 28, 2021

(54) VARIABLE PORT MICROPHONE

(71) Applicant: Bose Corporation, Framingham, MA (US)

(72) Inventor: Jason Silver, Framingham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/686,436

(22) Filed: Nov. 18, 2019

(65) Prior Publication Data

US 2021/0152926 A1 May 20, 2021

(51) Int. Cl.

| | |
|---|---|
| ***H04R 1/32*** | (2006.01) |
| ***H04R 1/04*** | (2006.01) |
| ***H04R 1/40*** | (2006.01) |
| ***H04R 3/00*** | (2006.01) |

(52) U.S. Cl.

CPC ..... *H04R 1/326* (2013.01); *H04R 1/04* (2013.01); *H04R 1/406* (2013.01); *H04R 3/005* (2013.01)

(58) Field of Classification Search

CPC ..... H04R 1/222; H04R 1/245; H04R 1/265; H04R 1/342; H04R 1/38; H04R 1/406; H04R 9/08; H04R 19/04; H04R 3/005; H04R 2410/00; H04R 2410/01; H04R 2201/02

USPC .... 381/355, 356, 357, 358, 338, 91, 92, 122

See application file for complete search history.

(56) References Cited

U.S. PATENT DOCUMENTS 3,115,207 A 12/1963 Wiggins
3,378,649 A 4/1968 Mawby
4,334,740 A * 6/1982 Wray ..... G03B 31/00 352/11
4,789,044 A * 12/1988 Akino ..... H04R 1/38 181/158
5,121,426 A 6/1992 Baumhauer, Jr. et al.

(Continued)

FOREIGN PATENT DOCUMENTS

EP 0827360 A2 3/1998

OTHER PUBLICATIONS

Chinn, Rick; Variable-D And Beyond: Classic EV Microphone Design & Evolution; ProSoundWeb; Aug. 10, 2013; Website available at: https://www.prosoundweb.com/topics/education/variable_d_and_beyond_classic_ev_microphone_design_evolution/.

(Continued)

*Primary Examiner* — Xu Mei

(74) *Attorney, Agent, or Firm* — Bond, Schoeneck & King, PLLC

(57) ABSTRACT

A microphone assembly for providing improved directivity at high and low frequencies is disclosed. The microphone assemblies comprise two waveguides each having a microphone, a high-frequency port, and a low-frequency port. The two waveguides are arranged adjacent to each other so that the two low-frequency ports are arranged at a first distance apart from each other and so that the two high-frequency ports are arranged at a second distance apart from each other. The microphone assemblies may comprise two additional waveguides of different length than the first two waveguides, where the two additional waveguides also have low frequency ports and high frequency ports. When the four waveguides are arranged adjacent to each other, all the low-frequency ports are at one distance from each other and all the high-frequency ports are at another distance from each other.

20 Claims, 8 Drawing Sheets

(56) References Cited

U.S. PATENT DOCUMENTS 5,511,130 A * 4/1996 Bartlett ..... H04M 1/19 381/170
5,539,834 A * 7/1996 Bartlett ..... H04M 1/19 381/170
5,703,957 A * 12/1997 McAteer ..... H04R 1/38 381/92
8,422,715 B2 * 4/2013 Horibe ..... H04M 1/19 381/356
8,526,656 B2 * 9/2013 Tanaka ..... H04R 1/38 381/346
8,605,930 B2 * 12/2013 Takano ..... H04R 1/38 381/355
10,455,321 B2 * 10/2019 Bernal Castillo ..... H04R 1/08
2007/0177752 A1 * 8/2007 Kargus, IV ..... H04R 1/38 381/357
2007/0189563 A1 * 8/2007 Sjursen ..... H04R 25/48 381/321
2008/0013770 A1 * 1/2008 Wu ..... H04R 1/406 381/357
2016/0007107 A1 * 1/2016 Reese ..... H04R 1/08 381/174
2016/0142814 A1 * 5/2016 deRoo ..... H04R 1/38 381/357
2018/0167710 A1 * 6/2018 Silver ..... H04R 1/1075

OTHER PUBLICATIONS

New 666 Variable-D* Cardiod Outperforms All Others; Audio Magazine; May 1954; Available at: https://www.americanradiohistory.com/hd2/IDX-Audio/Archive-Audio-IDX/IDX/50s/Audio-1954-May-OCR-Page-0034.pdf#search=%22ev%20variable%20d%22.

International Search Report and the Written Opinion of the International Searching Authority, International Application No. PCT/US2020/053509, pp. 1-11, dated Dec. 2, 2020.

* cited by examiner

VARIABLE PORT MICROPHONE

BACKGROUND

The present disclosure generally relates to microphone assemblies.

SUMMARY

All examples and features mentioned below can be combined in any technically possible way.

Generally, in one aspect, a microphone assembly is provided. The microphone assembly comprises: a first waveguide, the first waveguide having a first high frequency port and a first low frequency port arranged on a front surface of the first waveguide; a first microphone arranged in communication with the first waveguide; a second waveguide, the second waveguide having a second high frequency port and a second low frequency port arranged on a front surface of the second waveguide; and a second microphone arranged in communication with the second waveguide. The first waveguide is arranged adjacent to the second waveguide such that the first and second low-frequency ports are arranged at a first distance from each other and the first and second high-frequency ports are arranged at a second distance from each other.

In an aspect, the first and second low-frequency ports have a first impedance, wherein the first and second high-frequency ports have a second impedance, and wherein the first impedance is different than the second impedance.

In an aspect, the first and second low-frequency ports have a first impedance, wherein the first and second high-frequency ports have a second impedance, and wherein the first impedance is less than the second impedance.

In an aspect, the first and second low-frequency ports have a first resistance, wherein the first and second high-frequency ports have a second resistance, and wherein the first resistance is less than the second resistance.

In an aspect, the microphone assembly has a first directivity at low frequencies ranging from approximately 100-1000 Hz and high frequencies ranging from approximately 2000-6000 Hz.

In an aspect, the microphone assembly has a first directivity at low frequencies ranging from approximately 100-1000 Hz and high frequencies ranging from approximately 2000-15000 Hz.

In an aspect, the first distance is approximately 60 mm and wherein the second distance is approximately 8 mm, or wherein the first distance is approximately 60 mm and wherein the second distance is approximately 4 mm.

In an aspect, the first and second low-frequency ports have a diameter of approximately 1 mm.

In an aspect, the first and second high-frequency ports have a diameter of approximately 4 mm and wherein the first and second high-frequency ports are covered with one or more materials which provide an impedance of approximately 600 Rayl.

In an aspect, the first and second high-frequency ports have a diameter of approximately 2 mm and wherein the first and second high-frequency ports are covered with one or more materials which provide an impedance of approximately 150 Rayl.

In an aspect, the first and second low-frequency ports are covered with one or more materials or geometric features which provide an inertance.

In an aspect, the first low-frequency port and the second low-frequency port have a first extension and a second extension, respectively, wherein the first and second extensions protrude into an interior of the first and second waveguide, respectively.

In an aspect, the first low-frequency port and the second low-frequency port have a first extension and a second extension, respectively, wherein the first and second extensions protrude to the exterior of the first and second waveguide, respectively.

In an aspect, the microphone assembly further comprises: a third waveguide, the third waveguide having a third high frequency port and a third low frequency port arranged on a front surface of the third waveguide; a third microphone arranged in communication with the third waveguide; a fourth waveguide, the fourth waveguide having a fourth high frequency port and a fourth low frequency port arranged on a front surface of the fourth waveguide; and a fourth microphone arranged in communication with the fourth waveguide. The first waveguide and the second waveguide have a first length. The third waveguide and the fourth waveguide have a second length. The first waveguide is arranged adjacent to the second waveguide, and the third waveguide is arranged adjacent to the fourth waveguide such that the first, second, third, and fourth low-frequency ports are arranged at a low-frequency port distance from each other and the first, second, third, and fourth high-frequency ports are arranged at a high-frequency port distance from each other.

Generally, in one aspect, a microphone assembly is provided. The microphone assembly comprises: a first waveguide, the first waveguide having a first high-frequency port, a first mid-frequency port, and a first low-frequency port arranged on a front surface of the first waveguide; a first microphone arranged in communication with the first waveguide; a second waveguide, the second waveguide having a second high-frequency port, a second mid-frequency port, and a second low-frequency port arranged on a front surface of the second waveguide; and a second microphone arranged in communication with the second waveguide. The first waveguide is arranged adjacent to the second waveguide such that the first and second low-frequency ports are arranged at a first distance from each other, such that the first and second high-frequency ports are arranged at a second distance from each other, and such that the first and second mid-frequency ports are arranged at a third distance from each other.

In an aspect, the first and the second low-frequency ports have a first impedance, wherein the first and the second high-frequency ports have a second impedance, and wherein the first and the second mid-frequency ports have a third impedance, wherein the first impedance, the second impedance, and the third impedance are different than each other.

In an aspect, the first and the second low-frequency ports have a first impedance, wherein the first and the second high-frequency ports have a second impedance, wherein the first and the second mid-frequency ports have a third impedance, and wherein the first impedance is less than the third impedance below a first frequency and the third impedance is less than the second impedance above the first frequency and below a second frequency, and the second impedance is below the first and third impedance above the second frequency.

In an aspect, the microphone assembly has a first directivity at low frequencies ranging from approximately 100 HZ to 1000 Hz, medium frequencies ranging from approximately 1000 Hz to 6000 HZ, and high frequencies ranging from approximately 6000 Hz to 15000 Hz.

In an aspect, the first distance is approximately 60 mm, wherein the second distance is approximately 8 mm, and wherein the third distance is approximately 30 mm.

In an aspect, the first and the second low-frequency ports have a first resistance, wherein the first and the second high-frequency ports have a second resistance, wherein the first and the second mid-frequency ports have a third resistance, and wherein the first resistance is less than the third resistance and the third resistance is less than the second resistance.

DETAILED DESCRIPTION

The present application discloses microphone assemblies that provide improved directive performance at low and high frequencies. The microphone assemblies disclosed herein can reduce the number of microphones required in a microphone array and/or increase performance with a similar number of microphones. Such microphone assemblies are configured to provide better performance with less microphone self-noise and with arrays that are more directive at low frequencies. In general, the microphone assemblies of the present application comprise two waveguides each having a microphone, a high-frequency port, and a low-frequency port. The two waveguides are arranged adjacent to each other so that the two low-frequency ports are arranged at a first distance apart from each other and so that the two high-frequency ports are arranged at a second distance apart from each other.

Figure 1:
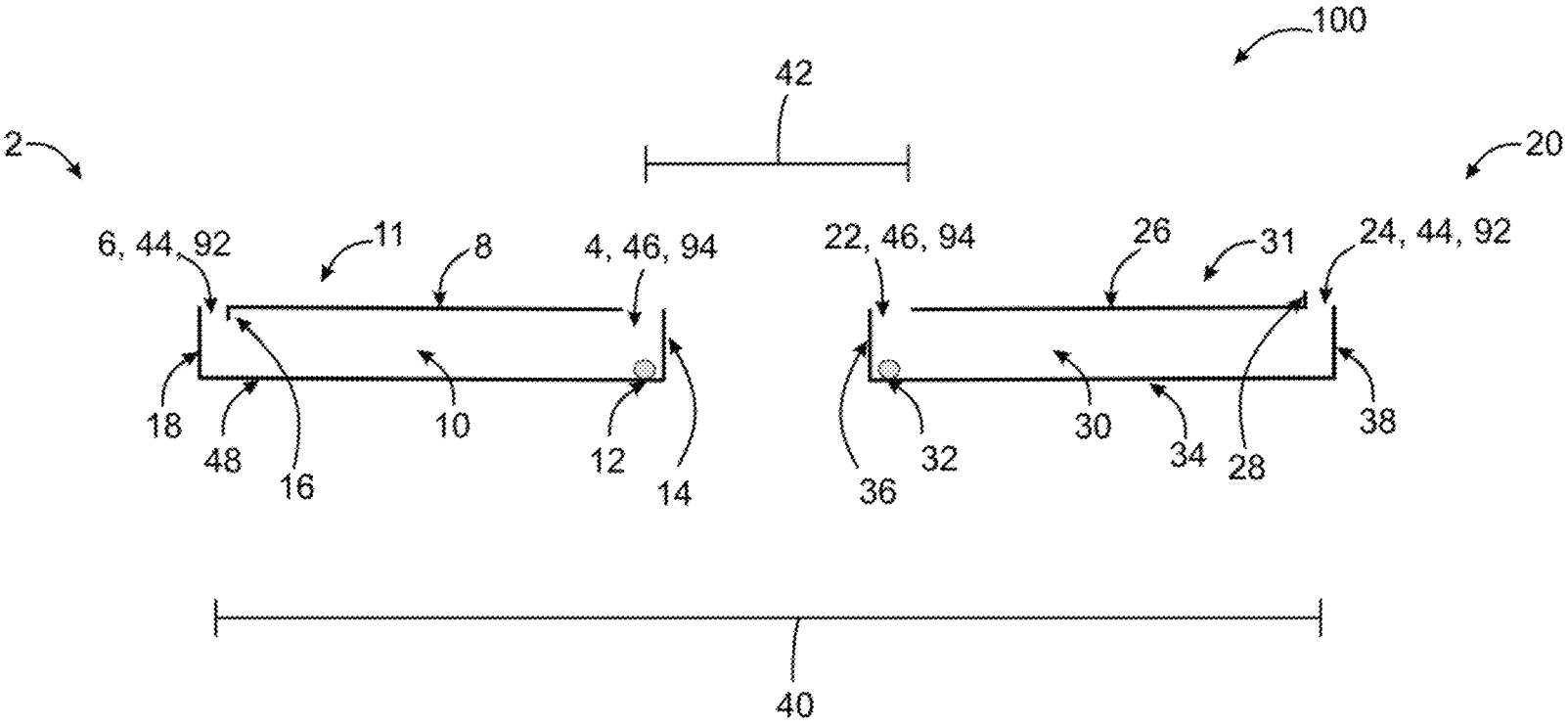
FIG. 1 illustrates an example of a microphone assembly according to aspects of the present disclosure.

FIG. 1 illustrates a microphone assembly 100 according to aspects of the preset disclosure. The microphone assembly 100 includes a first waveguide 2 having a first high-frequency port 4 and a first low-frequency port 6 on a front surface 8 of the first waveguide 2. The first low-frequency port 6 has a first extension 16 which is a protrusion coming from the front surface 8 of the first waveguide 2 to the interior 10 of the first waveguide 2. The first extension 16 may extend to the exterior 11 of the waveguide. The first extension 16 provides inertance to the first low-frequency port 6. The first waveguide 2 also has a first microphone 12 in communication with the first waveguide 2. The first microphone 12 is arranged on a back surface 48 of the first waveguide 2, along a surface of the waveguide that faces the interior 10 of the waveguide 2. The first microphone 12 is located across from the first high-frequency port 4 and along a first side surface 14 of the first waveguide 2. The first low-frequency port 6 is arranged against a second side surface 18 of the first waveguide 2. Alternatively, the first microphone 12 may be placed anywhere within the first waveguide 2.

FIG. 1 also shows a second waveguide 20 having a second high-frequency port 22 and a second low-frequency port 24 on a front surface 26 of the second waveguide 20. The second low-frequency port 24 has a second extension 28 which is a protrusion coming from the front surface 26 of the second waveguide 20 to the interior 30 of the second waveguide 20. The second extension 28 may extend to the exterior 31 of the waveguide. The second extension 28 provides inertance to the second low-frequency port 24. The second waveguide 20 also has a second microphone 32 in communication with the second waveguide 20. The first and second microphones may be omnidirectional microphones and may be microelectromechanical systems (MEMS) microphones. The second microphone 32 is arranged on a back surface 34 of the second waveguide 20, along a surface of the waveguide that faces the interior 30 of the waveguide 20. The second microphone 32 is located across from the second high-frequency port 22 and along a first side surface 36 of the second waveguide 20. The second low-frequency port 24 is arranged against a second side surface 38 of the second waveguide 20. Alternatively, the second microphone 32 may be placed anywhere within the second waveguide 20.

The first waveguide 2 is arranged adjacent to the second waveguide 20 such that the first low-frequency port 6 and the second low-frequency port 24 are arranged at a first distance 40 from each other and the first high-frequency port 4 and the second high-frequency port 22 are arranged at a second distance 42 from each other. The first distance 40 between the first and second low-frequency ports 6, 24 may be approximately 60 mm and the second distance 42 between the first and second high-frequency ports 4, 22 may be approximately 8 mm. Alternatively, the first distance 40 between the first and second low-frequency ports 6, 24 may be approximately 60 mm and the second distance 42 between the first and second high-frequency ports 4, 22 may be approximately 4 mm.

The first and second low-frequency ports 6, 24 may be covered with materials that have different impedance than the materials which cover the first and second high-frequency ports 4, 22 to aid in the frequency selectivity of the ports, or they may have different geometric arrangements which provide different impedance. The first and second low-frequency ports 6, 24 may be covered with materials that give the first and second low-frequency ports 6, 24 a first impedance 44. The first and second high-frequency ports 4, 22 may be covered with materials that give the first and second high-frequency ports 4, 22 a second impedance 46 which is different than the first impedance 44. The first impedance 44 may be less than the second impedance 46. The first and second low-frequency ports 6, 24 may be covered with materials that give the first and second low-frequency ports 6, 24 a first resistance 92. The first and second high-frequency ports 4, 22 may be covered with materials that give the first and second high-frequency ports 4, 22 a second resistance 94 which is different than the first resistance 92. The first resistance 92 may be less than the second resistance 94. As an example, the diameter of the first and second low-frequency ports 6, 24 may be approximately 1 mm. The diameter of the first and second high-frequency ports 4, 22 may be larger than the diameter of the low-frequency ports 6, 24 and may be 2 mm. The first impedance may have negligible resistance and the second impedance may be defined by a 150 Rayl screen. As another example, the diameter of the first and second high-frequency ports 4, 22 may be 4 mm and the second impedance may be defined by a 600 Rayl screen. The first and second waveguides 2, 20 may be rectangular in shape with the front 8, 26 and back 48, 34 surfaces substantially parallel to each other. The front 8, 26 and back 48, 34 surfaces of the first and second waveguides 2, 20 may be arranged at a distance approximately 1 mm apart.

Figure 2A:
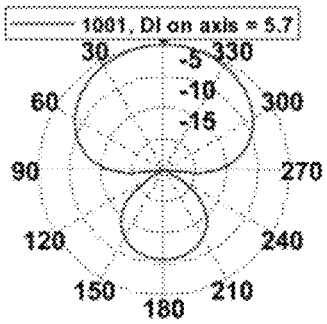
FIGS. 2A-B are graphs showing the directivity of microphone assemblies.
Figure 2B:
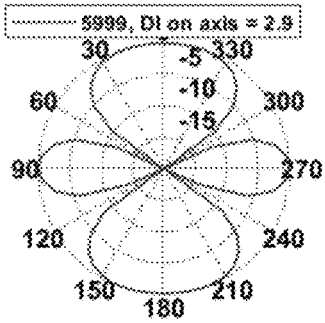

FIGS. 2A and 2B compare directivity indices at two frequencies utilizing prior art microphone assemblies. The sound captured by the microphone assemblies has directivity and sounds from some directions are captured better than sounds from other directions by the microphone assemblies. As an example, FIG. 2A is graph which shows the directions from which sound is captured by the microphone assembly at a frequency of approximately 1000 Hz. FIG. 2A a top down view showing angles around an axis, where the axis is perpendicular with the page, which show the directions from which sound is captured. More sound is captured from the angles from zero degrees to 60 degrees and from 300 degrees to 360 degrees than in the angles from 240 degrees to 270 degrees and from 90 degrees to 120 degrees. Some sound is captured from the direction from 150 degrees to 210 degrees around the axis, but this sound is less than the sound captured from zero to 60 degrees or 300 to 360 degrees. The directivity of the sound captured by a microphone assembly is frequency dependent. At 6000 Hz, shown in FIG. 2B, the microphone assembly picks up about as much sound from the direction at zero degrees as it does from the direction at 180 degrees, and the microphone assembly picks up some sound from the directions at 90 degrees and 270 degrees. At 1000 Hz, shown in FIG. 2A, the microphone assembly 100 picks up more sound from the direction at zero degrees than it does from the direction at 180 degrees. The microphone assembly shown in FIGS. 2A and 2B has higher directivity at 1000 Hz than at 6000 Hz. At 1000 Hz the majority of the sound is picked up from the direction around zero degrees, whereas at 6000 Hz, sound is picked up from all directions without a single dominant direction. The microphone assembly shown in FIGS. 2A and 2B has directivity at 1000 Hz but different and less directivity at 6000 Hz. A directivity index measuring how focused the sound pick up is along the zero degrees direction is 5.7 dB at 1000 Hz (shown in FIG. 2A) and 2.9 dB at 6000 Hz (shown in FIG. 2B).

Figure 3B:
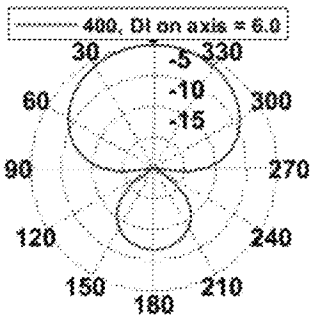
FIGS. 3A-F are graphs showing the directivity of microphone assemblies according to aspects of the present disclosure.
Figure 3A:
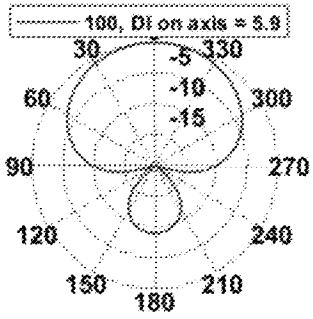
Figure 3C:
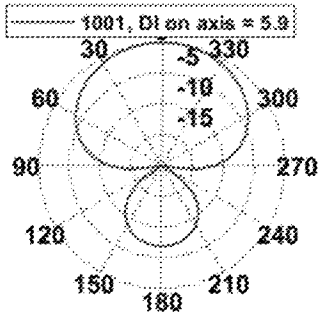
Figure 3E:
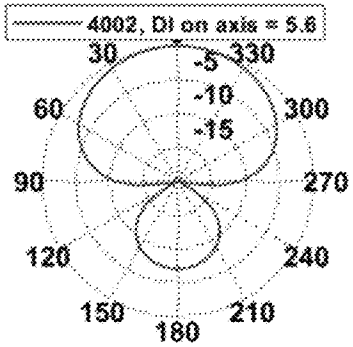
Figure 3F:
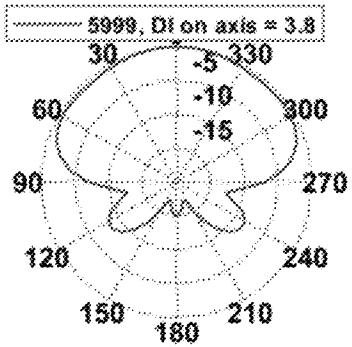
Figure 3D:
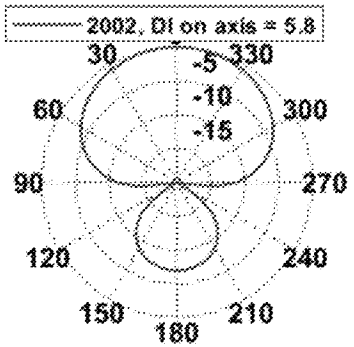

The microphone assembly 100 of the present disclosure has a first directivity, corresponding to high directivity, at low frequencies ranging from 100-1000 HZ and similar directivity, a first directivity, at high frequencies ranging from 2000-6000 Hz and higher frequencies ranging up to approximately 1500 Hz. In general, high directivity corresponds with directivity indices from approximately 4 dB to 6 dB and higher. For example, FIGS. 3A-C which show directivity indices at 100 Hz, 400 Hz, and 1000 Hz, respectively, show high directivity by the microphone assemblies at low frequencies. As another example, FIGS. 3D-F show that the directivity of sound pick up at 2000 Hz, 4000 Hz, and 6000 Hz, respectively, is high. As the frequency is increased the microphone assemblies continue to have high directivity. For example, the microphone assemblies have high directivity continuing up to frequencies approaching approximately 6000 Hz and continuing up to approximately 1500 Hz.

Figure 4:
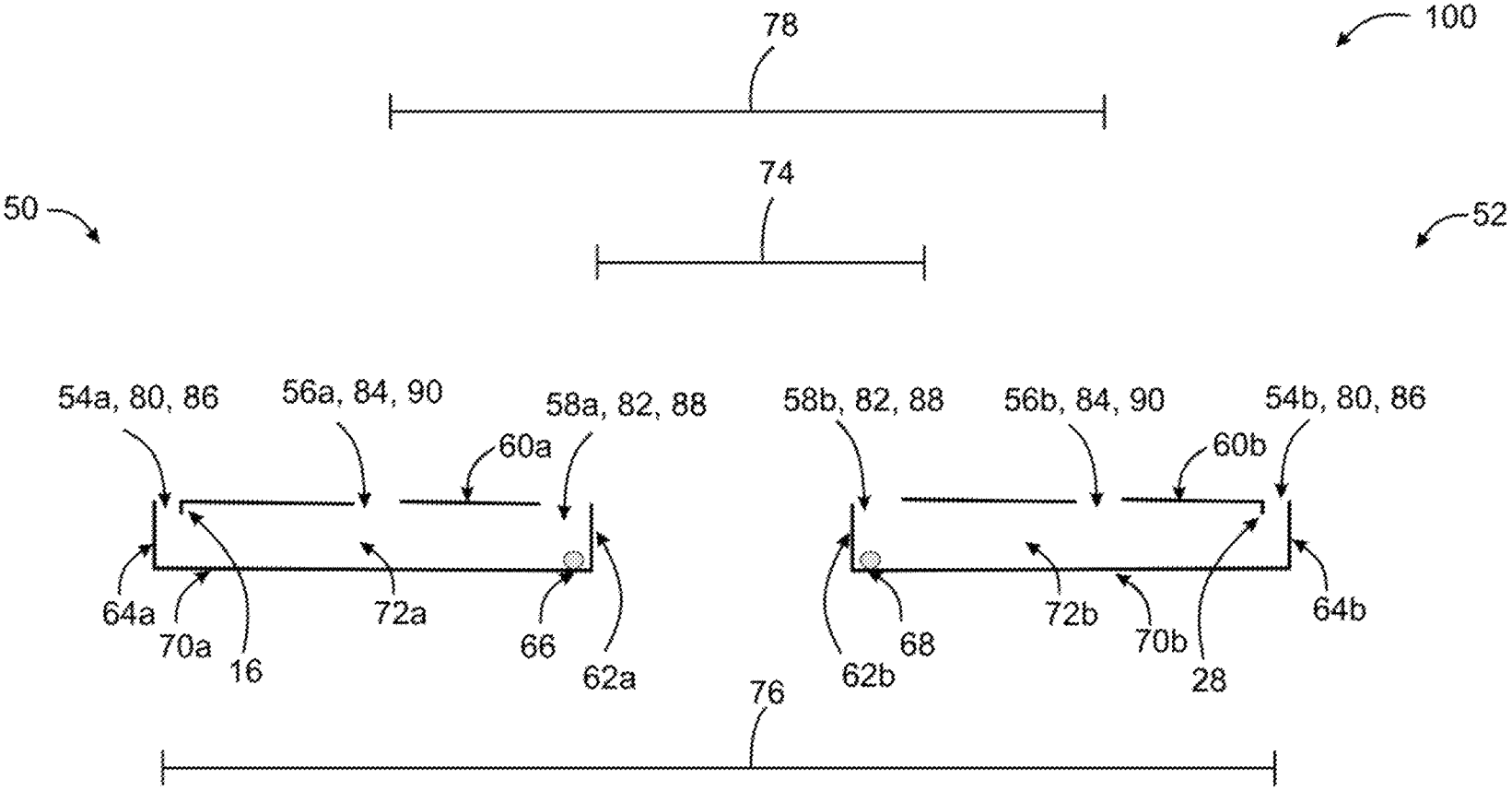
FIG. 4 illustrates an example of a microphone assembly according to aspects of the present disclosure.

FIG. 4 shows a first waveguide 50 and a second waveguide 52 each having a low-frequency port 54*a*, 54*b*, a mid-frequency port 56*a*, 56*b*, and a high-frequency port 58*a*, 58*b* arranged on a front surface 60*a*, 60*b* of the waveguides 50, 52. The high-frequency ports 58*a*, 58*b* are arranged adjacent to a first side surface 62*a*, 62*b* of the waveguides 50, 52. The low-frequency ports 54*a*, 54*b*, are arranged adjacent to a second side surface 64*a*, 64*b* of the waveguides 50, 52, and the mid-frequency ports 56*a*, 56*b* are arranged between the high-frequency ports 58*a*, 58*b* and the low-frequency ports 54*a*, 54*b*. The first waveguide 50 has a first microphone 66 in communication with the first waveguide 50, and the second waveguide 52 has a second microphone 68 in communication with the second waveguide 52. The first and second microphones 66, 68 may be omnidirectional microphones and may be microelectromechanical systems (MEMS) microphones. The first microphone 66 may be arranged on the back surface 70*a* of the first waveguide 50, along a surface of the waveguide 50 that faces the interior 72*a* of the waveguide 50. Similarly, second microphone 68 may be arranged on the back surface 70*b* of the second waveguide 52, along a surface of the waveguide that faces the interior 72*b* of the second waveguide 52. The first microphone 66 may be located across from the high-frequency port 58*a* of the first waveguide 50, and the second microphone 68 may be located across from the high-frequency port 58*b* of the second waveguide 52.

The first waveguide 50 is arranged adjacent to the second waveguide 52 such that the low-frequency ports 54*a*, 54*b* are arranged at a first distance 74 from each other, the high-frequency ports 58*a*, 58*b* are arranged at a second distance 76 from each other, and the mid-frequency ports 56*a*, 56*b* are arranged at a third distance 78 from each other. The first distance 74 between the low-frequency ports 54*a*, 54*b* may be approximately 60 mm, the second distance 76 between the high-frequency ports 58*a*, 58*b* may be approximately 8 mm, and the third distance 78 between the mid-frequency ports 56*a*, 56*b* may be approximately 30 mm.

The low-frequency ports 54*a*, 54*b*, high-frequency ports 58*a*, 58*b*, and mid-frequency ports 56*a*, 56*b* may be covered with materials that provide different impedance and inertance than each other to aid in the frequency selectivity of the ports, or the materials that cover the ports may have a geometric arrangement that provides the different impedances. The low-frequency ports 54*a*, 54*b* may be covered with materials that give the low-frequency ports 54*a*, 54*b* a first impedance 80. The high-frequency ports 58*a*, 58*b* may be covered with materials that give the high-frequency ports 58*a*, 58*b* a second impedance 82. The mid-frequency ports 56*a*, 56*b* may be covered with materials that give the mid-frequency ports 56*a*, 56*b* a third impedance 84. The first impedance 80, second impedance 82, and third impedance 84 may be different from each other. The first impedance 80 may be less than the third impedance 84 below a first frequency, and the third impedance 84 may be less than the second impedance 82 above the first frequency and below a second frequency. The second impedance 82 may be below the first and third impedance 80, 84 above the second frequency. The low-frequency ports 54*a*, 54*b* may be covered with materials that give the low-frequency ports 54*a*, 54*b* a first inertance and a first resistance 86. The high-frequency ports 58*a*, 58*b* may be covered with materials that give the high-frequency ports 58*a*, 58*b* a second inertance and a second resistance 88. The mid-frequency ports 56*a*, 56*b* may be covered with materials that give the mid-frequency ports 56*a*, 56*b* a third inertance and a third resistance 90. The first inertance, second inertance, and third inertance may be different from each other. The first inertance may be greater than the third inertance, and the third inertance may be greater than the second inertance. The first resistance 86 may be less than the third resistance 90, and the third resistance 90 may be less than the second resistance 88.

Figure 5A:
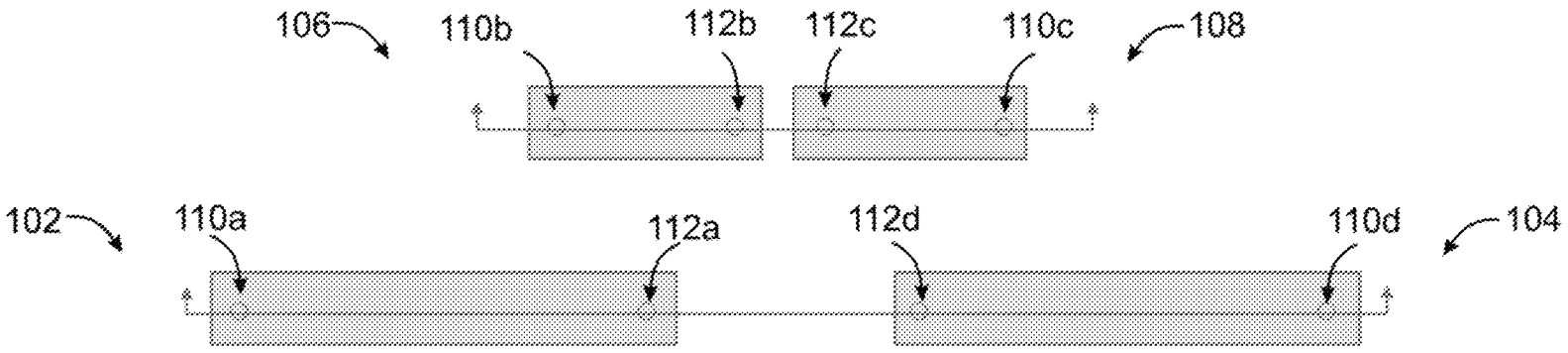
FIGS. 5A-5D illustrate exemplary microphone assemblies according to aspects of the present disclosure.
Figure 5B:
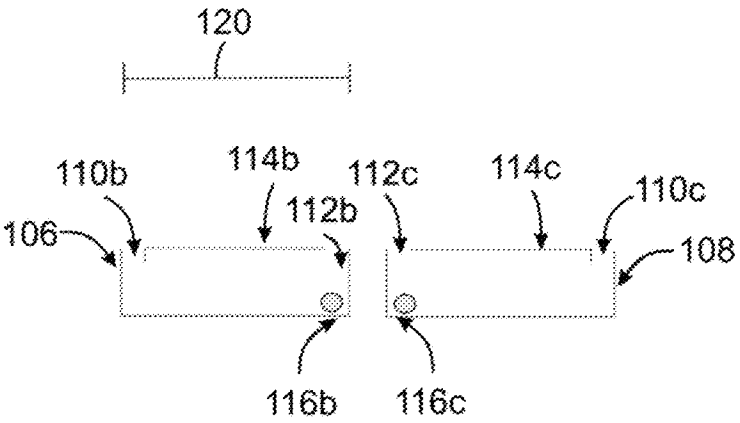
Figure 5C:
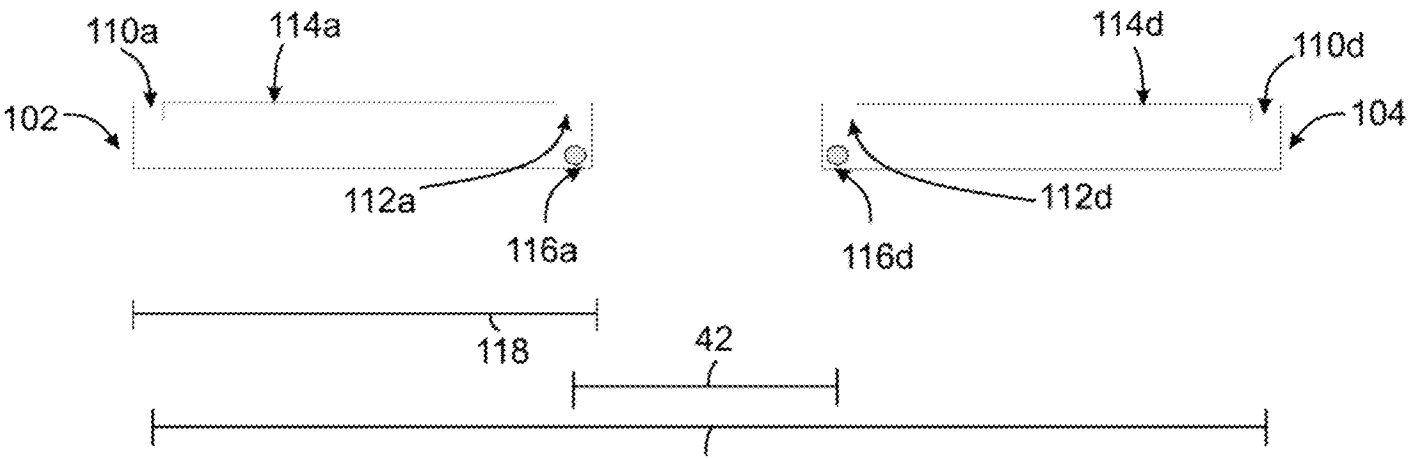
Figure 5D:
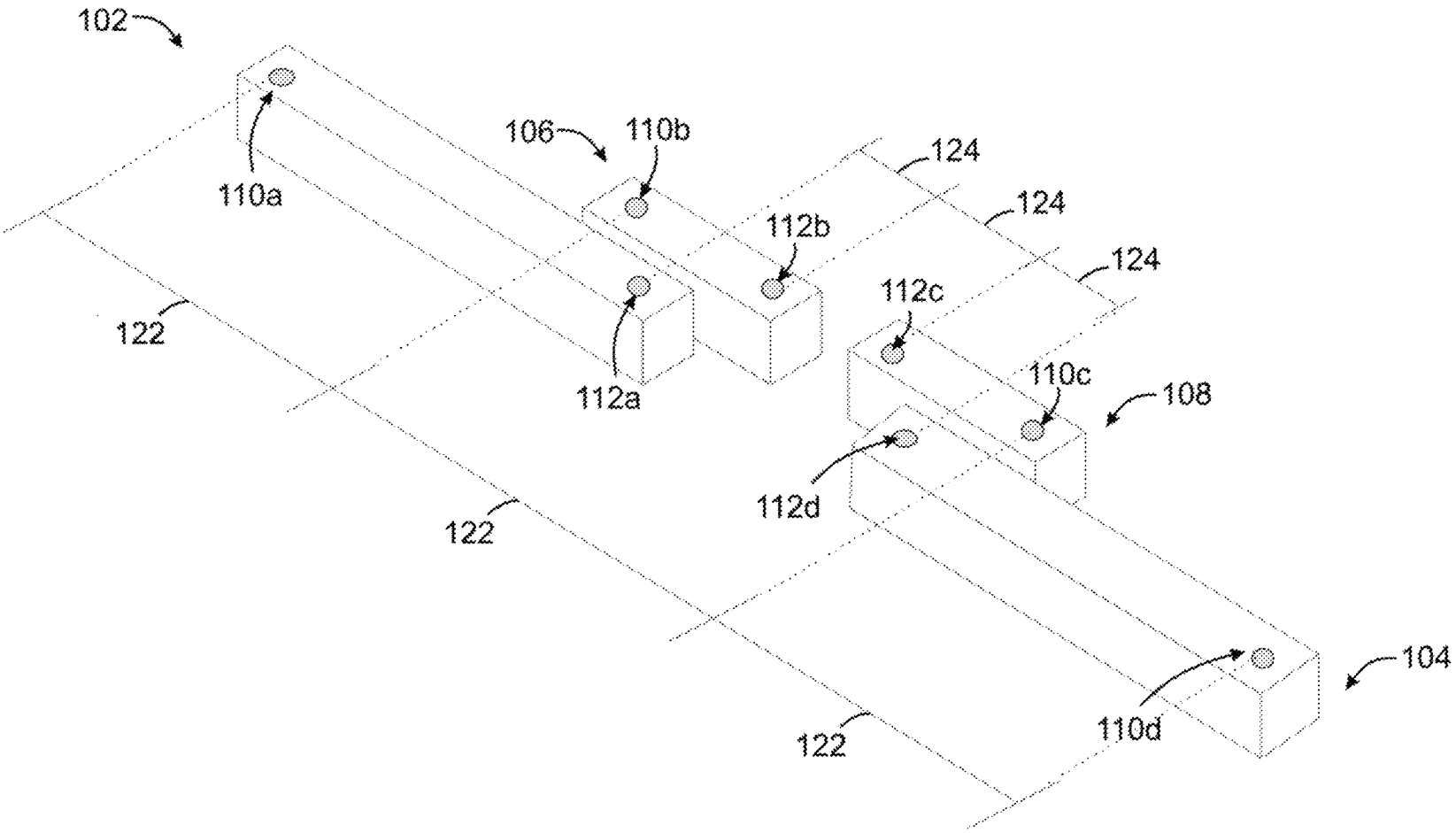

FIGS. 5A-5D show a first waveguide 102, a second waveguide 104, a third waveguide 106, and a fourth waveguide 108 each having low-frequency ports 110*a-d* and high-frequency ports 112*a-d* arranged on front surfaces 114*a-d* of the waveguides 102, 104, 106, 108. FIG. 5A is a top down view of waveguides 102, 104, 106, and 108. Although illustrated as cylindrical, it should be appreciated that the low-frequency ports 110*a-d* and high-frequency ports 112*a-d* can be any other shape, such as a rectangular prism, a polygonal prism, etc. FIG. 5B is a cross-sectional view of the third waveguide 106 and the fourth waveguide 108. FIG. 5C is a cross-sectional view of the first waveguide 102 and the second waveguide 104. The high-frequency ports 112*a-d* are arranged adjacent to a first side surface of the waveguides 102, 104, 106, 108. The low-frequency ports 110*a-d* are arranged adjacent to a second side surface of the waveguides 102, 104, 106, 108. The first waveguide 102 has a first microphone 116*a* in communication with the first waveguide 102, the second waveguide 104 has a second microphone 116*d* in communication with the second waveguide 104, the third waveguide 106 has a third microphone 116*b* in communication with the third waveguide 106, and the fourth waveguide 108 has a fourth microphone 116*c* in communication with the fourth waveguide 108. The first, second, third, and fourth microphones 116*a-d* may be omnidirectional microphones and may be microelectromechanical systems (MEMS) microphones. The first microphone 116*a* may be arranged on the back surface of the first waveguide 102, along a surface of the waveguide that faces the interior of the waveguide. Similarly, second, third, and forth microphones 116*b-d* may be arranged on a back surface of the second, third, and fourth waveguides 104, 106, 108, respectively, along a surface of the waveguides that faces the interior of the waveguides 104, 106, 108. The first microphone 116*a* may be located across from the high-frequency port 112*a* of the first waveguide 102, and the second, third, and fourth microphones 116*b-d* may also be located across from the high-frequency ports 112*b-d* of their respective waveguides.

The first waveguide 102 is arranged adjacent to the second waveguide 104 such that the first and second low-frequency ports 110*a*, 110*d* are arranged at a first distance 40 from each other and the first and second high-frequency ports 112*a*, 112*d* are arranged at a second distance 42 from each other (shown in FIG. 5C). The third waveguide 106 is arranged adjacent to the fourth waveguide 108. The first waveguide 102 is arranged adjacent to the third waveguide 106, and the second waveguide 104 is arranged adjacent to the fourth waveguide 108. The first, second, third, and fourth waveguides 102, 104, 106, and 108 are arranged such that the first, second, third, and fourth low-frequency ports 110*a-d* are arranged at a low-frequency port distance 122 from each other and the first, second, third, and fourth high-frequency ports 112*a-d* are arranged at a high-frequency port distance 124 from each other (shown in FIG. 5D). The first and second waveguides 102, 104 are of a first length 118, and the third and fourth waveguides 106,108 are of a second length 120. As an example, the low-frequency port distance 122 between the low-frequency ports 110*a-d* may be approximately 60 mm and the high-frequency port distance 124 between the high-frequency ports 112*a-d* may be approximately 4 mm. The distance between the high-frequency ports 112*a-d*, the distance between the low-frequency ports 110*a-d*, the inertance of materials on the ports, the impedance of materials on the ports, the resistance of materials on the ports, and other known parameters may also be modified to achieve high directivity at low frequencies and high directivity at high frequencies as described.

By utilizing the microphone assemblies of the present disclosure, the microphone assemblies can have a first directivity, corresponding to high directivity at low frequencies ranging from approximately 100 Hz to 1000 Hz, medium frequencies ranging from approximately 1000 Hz to 6000 Hz, and high frequencies ranging from approximately 6000 Hz to 15000 Hz.

The above-described examples of the described subject matter can be implemented in any of numerous ways. Other implementations are within the scope of the following claims and other claims to which the applicant may be entitled.

While various examples have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the examples described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific examples described herein. It is, therefore, to be understood that the foregoing examples are presented by way of example only and that, within the scope of the appended claims and equivalents thereto, examples may be practiced otherwise than as specifically described and claimed. Examples of the present disclosure are directed to each individual feature, system, article, material, and/or method described herein. In addition, any combination of two or more such features, systems, articles, materials, kits, and/or methods, if such features, systems, articles, materials, and/or methods are not mutually inconsistent, is included within the scope of the present disclosure.

The invention claimed is:

1. A microphone assembly, comprising:

a first waveguide, the first waveguide having a first high frequency port and a first low frequency port arranged on a front surface of the first waveguide;

a first microphone arranged in communication with the first waveguide and arranged closer to the first high frequency port than the first low frequency port;

a second waveguide, the second waveguide having a second high frequency port and a second low frequency port arranged on a front surface of the second waveguide; and a second microphone arranged in communication with the second waveguide and arranged closer to the second high frequency port than the second low frequency port;

wherein the first waveguide is arranged adjacent to the second waveguide such that the first and second low-frequency ports are arranged at a first distance from each other and the first and second high-frequency ports are arranged at a second distance from each other.

2. The microphone assembly of claim 1, wherein the first and second low-frequency ports have a first impedance, wherein the first and second high-frequency ports have a second impedance, and wherein the first impedance is different than the second impedance.

3. The microphone assembly of claim 1, wherein the first and second low-frequency ports have a first impedance, wherein the first and second high-frequency ports have a second impedance, and wherein the first impedance is less than the second impedance.

4. The microphone assembly of claim 1, wherein the first and second low-frequency ports have a first resistance, wherein the first and second high-frequency ports have a second resistance, and wherein the first resistance is less than the second resistance.

5. The microphone assembly of claim 1, wherein the microphone assembly has a first directivity at low frequencies ranging from approximately 100-1000 Hz and high frequencies ranging from approximately 2000-6000 Hz.

6. The microphone assembly of claim 1, wherein the microphone assembly has a first directivity at low frequencies ranging from approximately 100-1000 Hz and high frequencies ranging from approximately 2000-15000 Hz.

7. The microphone assembly of claim 1, wherein the first distance is approximately 60 mm and wherein the second distance is approximately 8 mm, or wherein the first distance is approximately 60 mm and wherein the second distance is approximately 4 mm.

8. The microphone assembly of claim 1, wherein the first and second low-frequency ports have a diameter of approximately 1 mm.

9. The microphone assembly of claim 1, wherein the first and second high-frequency ports have a diameter of approximately 4 mm and wherein the first and second high-frequency ports are covered with one or more materials which provide an impedance of approximately 600 Rayl.

10. The microphone assembly of claim 1, wherein the first and second high-frequency ports have a diameter of approximately 2 mm and wherein the first and second high-frequency ports are covered with one or more materials which provide an impedance of approximately 150 Rayl.

11. The microphone assembly of claim 1, wherein the first and second low-frequency ports are covered with one or more materials or geometric features which provide an inertance.

12. The microphone assembly of claim 1, wherein the first low-frequency port and the second low-frequency port have a first extension and a second extension, respectively, wherein the first and second extensions protrude into an interior of the first and second waveguide, respectively.

13. The microphone assembly of claim 1, wherein the first low-frequency port and the second low-frequency port have a first extension and a second extension, respectively, wherein the first and second extensions protrude to the exterior of the first and second waveguide, respectively.

14. The microphone assembly of claim 1, further comprising:

a third waveguide, the third waveguide having a third high frequency port and a third low frequency port arranged on a front surface of the third waveguide; and a third microphone arranged in communication with the third waveguide;

a fourth waveguide, the fourth waveguide having a fourth high frequency port and a fourth low frequency port arranged on a front surface of the fourth waveguide; and a fourth microphone arranged in communication with the fourth waveguide;

wherein the first waveguide and the second waveguide have a first length and wherein the third waveguide and the fourth waveguide have a second length, wherein the first waveguide is arranged adjacent to the second waveguide and the third waveguide is arranged adjacent to the fourth waveguide such that the first, second, third, and fourth low-frequency ports are arranged at a low-frequency port distance from each other and the first, second, third, and fourth high-frequency ports are arranged at a high-frequency port distance from each other.

15. A microphone assembly, comprising:

a first waveguide, the first waveguide having a first high-frequency port, a first mid-frequency port, and a first low-frequency port arranged on a front surface of the first waveguide;

a first microphone arranged within an internal cavity of the first waveguide and arranged closer to the first high frequency port than the first low frequency port, wherein the first high frequency port and the first low frequency port are both in communication with the internal cavity;

a second waveguide, the second waveguide having a second high-frequency port, a second mid-frequency port, and a second low-frequency port arranged on a front surface of the second waveguide; and a second microphone arranged within an internal cavity of the second waveguide and arranged closer to the second high frequency port than the second low frequency port, wherein the second high frequency port and the second low frequency port are both in communication with the internal cavity of the second waveguide;

wherein the first waveguide is arranged adjacent to the second waveguide such that the first and second low-frequency ports are arranged at a first distance from each other, such that the first and second high-frequency ports are arranged at a second distance from each other, and such that the first and second mid-frequency ports are arranged at a third distance from each other.

16. The microphone assembly of claim 15, wherein the first and the second low-frequency ports have a first impedance, wherein the first and the second high-frequency ports have a second impedance, and wherein the first and the second mid-frequency ports have a third impedance, wherein the first impedance, the second impedance, and the third impedance are different than each other.

17. The microphone assembly of claim 15, wherein the first and the second low-frequency ports have a first impedance, wherein the first and the second high-frequency ports have a second impedance, wherein the first and the second mid-frequency ports have a third impedance, and wherein the first impedance is less than the third impedance below a first frequency and the third impedance is less than the second impedance above the first frequency and below a second frequency, and the second impedance is below the first and third impedance above the second frequency.

18. The microphone assembly of claim 15, wherein the microphone assembly has a first directivity at low frequencies ranging from approximately 100 HZ to 1000 Hz, medium frequencies ranging from approximately 1000 Hz to 6000 HZ, and high frequencies ranging from approximately 6000 Hz to 15000 Hz.

19. The microphone assembly of claim 15, wherein the first distance is approximately 60 mm, wherein the second distance is approximately 8 mm, and wherein the third distance is approximately 30 mm.

20. The microphone assembly of claim 15, wherein the first and the second low-frequency ports have a first resistance, wherein the first and the second high-frequency ports have a second resistance, wherein the first and the second mid-frequency ports have a third resistance, and wherein the first resistance is less than the third resistance and the third resistance is less than the second resistance.

* * * * *